US007699495B2

(12) United States Patent
Au

(10) Patent No.: US 7,699,495 B2
(45) Date of Patent: Apr. 20, 2010

(54) INFLATABLE LIGHT STICK

(75) Inventor: Ying Yee Au, Kowloon (HK)

(73) Assignee: Asia Global Corporation Ltd., Kowloon (HK)

( * ) Notice: Subject to any disclaimer, the term of this patent is extended or adjusted under 35 U.S.C. 154(b) by 5 days.

(21) Appl. No.: 12/230,975

(22) Filed: Sep. 9, 2008

(65) Prior Publication Data

US 2009/0067163 A1 Mar. 12, 2009

(30) Foreign Application Priority Data

Sep. 12, 2007 (CN) ..... 2007 2 0175822 U

(51) Int. Cl.
*F21L 4/00* (2006.01)

(52) U.S. Cl. ..... 362/208; 362/84; 362/352; 362/390

(58) Field of Classification Search ..... 362/84, 362/196, 205, 208, 352, 369, 390; 446/219, 446/220

See application file for complete search history.

(56) References Cited

U.S. PATENT DOCUMENTS 2,905,863 A * 9/1959 Martin et al. ..... 362/390
7,121,676 B1 * 10/2006 Kutnyak ..... 362/234
7,413,494 B2 * 8/2008 Huang ..... 446/219
2008/0311820 A1 * 12/2008 Murdock ..... 446/220

FOREIGN PATENT DOCUMENTS

FR 2356225 A * 2/1978

* cited by examiner

*Primary Examiner*—Y My Quach Lee
(74) *Attorney, Agent, or Firm*—Bacon & Thomas, PLLC

(57) ABSTRACT

An inflatable light stick includes an inflatable bag body, an inflation inlet provided at a first end of the bag body, and a light emitting circuit provided in the bag body at a second end thereof. The light emitting circuit includes a controller, which has a front end extended into the bag body, and a rear end outward projected from the bag body to serve as a power-on control. Air can be blown via the inflation inlet to inflate the bag body, and the controller can be pulled to supply power from batteries to the light-emitting diode, making the inflated bag body firm and upright while showing colorful lights, and suitable for use as an eye-catching light stick for waving to create joyful and exciting atmosphere and achieve enhanced entertaining effect.

6 Claims, 7 Drawing Sheets

INFLATABLE LIGHT STICK

FIELD OF THE INVENTION

The present invention relates to an entertaining device, and more particularly to an inflatable light stick.

BACKGROUND OF THE INVENTION

Famous athletes, singers, and movie stars always attract young people. For example, whenever an outstanding basketball athlete scores a point or performs excellently, the fans and spectators around the court would cheer loudly and continuously. Similarly, in a big-scaled music performance, when the colorful lights change along with the signers' beautiful sound, the audience is intoxicated, shouts with joy, and waves all kinds of cheering devices to encourage the singers.

Due to the large number of fans, there is an amazing potential market for different cheering devices, such as cheering sticks, fluorescent sticks, fluorescent badges, electroluminescent (EL) cold light products, horns, whistles, EL light strips, and various kinds of novel luminous products. These products are constantly developed or improved, and introduced into the market.

Among others, the conventional glow stick is small in volume, easy to carry, and convenient to use, and therefore becomes the most welcomed cheering device in almost all the big-scaled meetings or events. When the glow stick is bent lightly, an inner tube thereof is broken, and two initially isolated substances are combined to produce light and create a unique visual effect and wonderful environmental atmosphere. However, the glow stick each can produce only one single color light which lasts for about 48 hours, and is a single-use product. It should be noted that some of the chemical substances being filled in the glow stick might cause cancer. In the event these chemical substances leak from the glow stick and are inhaled or touched by users, conditions unfavorable to human health, such as vomiting, nausea, dizziness, palsy, or even coma might appear. Therefore, the conventional glow stick has potential danger and is not recyclable to cause problems in environmental protection.

An electric light stick is a new generation of the glow sticks for use safely. As one example, Taiwanese Patent Publication No. 590042 discloses an improved glow stick that includes an ultraviolet fluorescent lamp and a set of fluorescent sleeves coated with a long-acting fluorescent agent and a fluorescent material. Light having a special wavelength emitted from the fluorescent lamp causes photoluminescence of the fluorescent sleeves. Meanwhile, due to the long-acting fluorescent agent, the photoluminescence of the fluorescent sleeves can extend for a long period of time even if the fluorescent lamp is turned off. Therefore, the electronic light stick has the advantages of having low power consumption, being repeatedly usable, and being environment-friendly without causing pollution.

There are still many differently designed light sticks employing light-emitting diode (LED) or cold light. Examples are seen in Chinese Patent Publication Nos. CN 2137554Y entitled Entertaining Spinning Stick, CN2506854Y entitled Light Stick, and CN 2790553Y entitled Musical and Luminescent Toy Magic Stick. These structures are internally provided with batteries and repeatedly usable, and are characterized by colorful flashing light emission.

However, all the above-listed conventional electronic light sticks have a fixed volume to be either too short or too long for use. To enable convenient carrying, the conventional light sticks usually have a short outer case and limited luminescent area, and are accordingly, not so useful in creating a joyful atmosphere. On the other hand, for the light sticks to be more eye-catching, they must have an increased length to provide increased luminescent area, and have more complicated circuit design to produce colorful lights. The lengthened light sticks have increased volume and could not be conveniently carried or stored.

It is therefore tried by the inventor to develop an inflatable light stick to overcome the problems existed in the conventional glow sticks.

SUMMARY OF THE INVENTION

A primary object of the present invention is to provide an inflatable light stick, which, when not in use, can be deflated and folded, and can therefore be easily stored in a small space and conveniently carried around. When it is desired to use the light stick, simply inflate the light stick and turn on a power supply thereof, so that an elongate and luminous light stick is formed for creating a joyful atmosphere in an environment.

To achieve the above and other objects, the inflatable light stick according to an embodiment of the present invention includes an inflatable bag body, an inflation inlet, a light emitting circuit, and a controller. The inflation inlet is located at a first end of the inflatable bag body. A user can blow air through the inflation inlet to inflate the bag body. The light emitting circuit is located in the inflatable bag body at a second end opposite to the first end. The controller is located at the second end of the inflatable bag body with a front end inserted into the inflatable bag body and a rear end outward projected from the inflatable bag body to serve as a power-on control.

In the present invention, the inflatable bag body is made of an inflatable plastic material containing a fluorescent material.

In the present invention, the inflation inlet is in the form of an elongate plastic bag partially sealed in the inflatable bag body. A front end of the inflation inlet is outward projected from the first end of the inflatable bag body and separated into two flaps. The light emitting circuit is embedded in an inner bag provided in a chamber formed in the bag body at the second end.

In the present invention, the light emitting circuit includes a battery compartment formed from a first and a second half-case that are closed to each other, and an impact-resistant soft enclosure. The first half-case is provided at a front end with a light-emitting diode, a pin of which is extended into the first half-case. An electrically conductive spring contact is provided in the first half-case at a rear end thereof to contact with another pin of the light-emitting diode. The second half-case and the soft enclosure each are formed at a position corresponding to electric contacts of the light emitting circuit with an opening. And, the controller includes an insulating pulling member serving as a power-on control. A front end of the pulling member is disposed between batteries of the light emitting circuit, and a rear end of the pulling member is extended through a hole to outward project from the second end of the bag body.

In an embodiment of the present invention, the controller is an on/off switch.

An inflatable light stick according to another embodiment of the present invention includes an inflatable bag body being provided at a first end with an inflation inlet, via which air can be blown to inflate the bag body. In a second end of the inflatable bag body, there is formed a chamber, in which an inner bag is provided for enclosing a light emitting circuit therein. An insulating pulling member is disposed between batteries of the light emitting circuit to serve as a power-on control. A rear end of the pulling member is extended through a hole to outward project from the second end of the bag body. The light emitting circuit includes a battery compartment formed from a first and a second half-case closed to each other, and an impact-resistant soft enclosure. A light-emitting diode is located at a front end of the first half-case with a pin extended into the first half-case, and an electrically conductive spring is located in a rear end of the first half-case to contact with another pin of the light-emitting diode. The second half-case and the soft enclosure each are provided at a position corresponding to electric contacts of the batteries with an opening, via which the pulling member can be extended into the soft enclosure and the battery compartment to separate the batteries from one another.

To use the light stick, a user needs only to blow air through the inflation inlet to inflate the bag body, and pull the controller for the light emitting circuit to operate, making the inflated bag body a rigid, luminous, and eye-catching light stick, which can be waved to create a joyful and exciting atmosphere while providing an enhanced entertaining effect.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
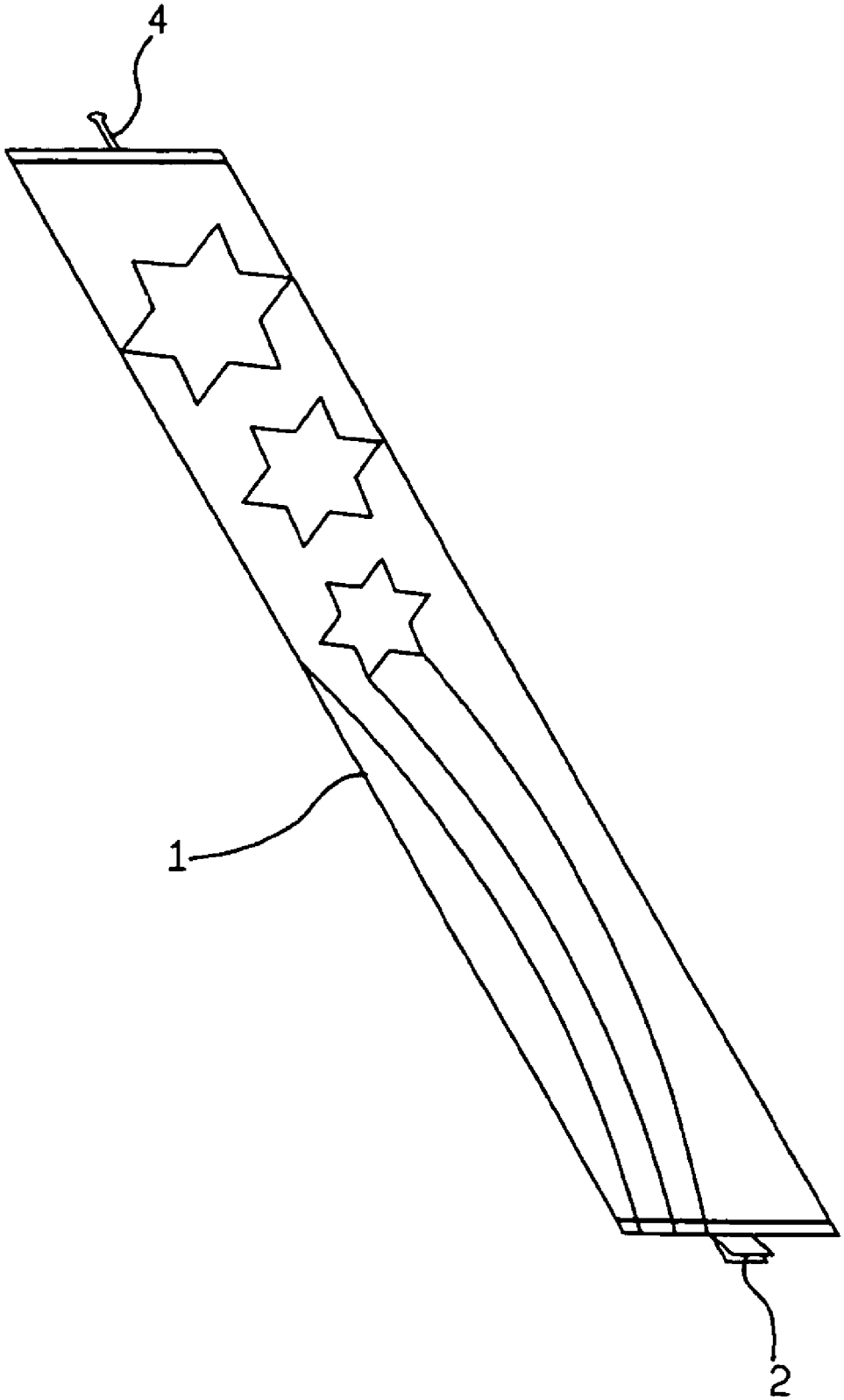
FIG. 1 is a perspective view of an inflatable light stick according to a preferred embodiment of the present invention before being inflated.

Please refer to FIGS. 1 to 6. The present invention relates to an inflatable light stick which mainly includes an inflatable bag body 1 being provided at a first end with an inflation inlet 2 for inflating the inflatable bag body 1 and at an opposite second end with a light emitting circuit 3. The light emitting circuit 3 includes a controller 4, which has an end outward projected from the second end of the inflatable body 1 to serve as a power-on control. When the inflatable bag body 1 is inflated via the inflation inlet 2, and the controller 4 is manipulated in a predetermined manner to power on the light emitting circuit for the same to operate, the inflated bag body 1 will form a rigid, upright, and luminous cheering device.

The inflatable bag body 1 can be made of a plastic material containing a fluorescent material, or be made of other inflatable plastic material. Various designs or patterns can be printed on an outer surface of the bag body 1 to achieve enhanced cheering effect in different occasions. The inflation inlet 2 is in the form of a small-sized elongate plastic bag 21 partially sealed in the inflatable bag body 1. A front end of the inflation inlet 2 is outward projected from the first end of the inflatable bag body 1 and separated into two flaps. The light emitting circuit 3 is embedded in an inner bag 31 provided in a chamber 32 formed in the bag body 1 at the second end.

Figure 2:
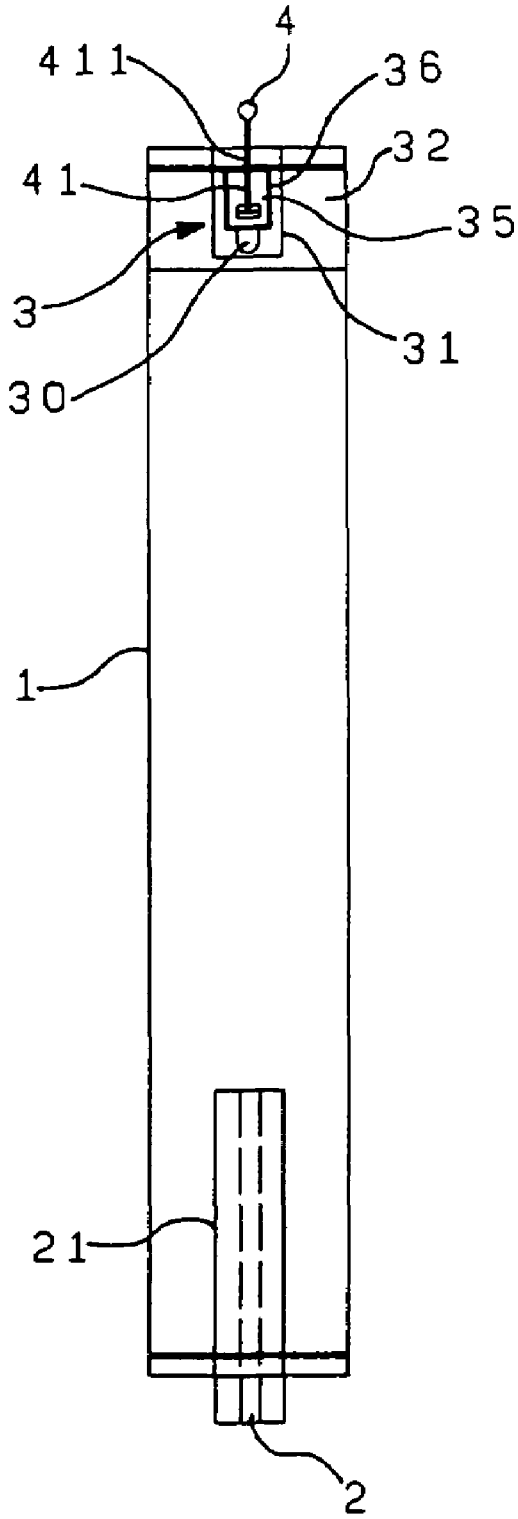
FIG. 2 is a plan view showing the arrangement inside the inflatable light stick of the present invention.
Figure 3:
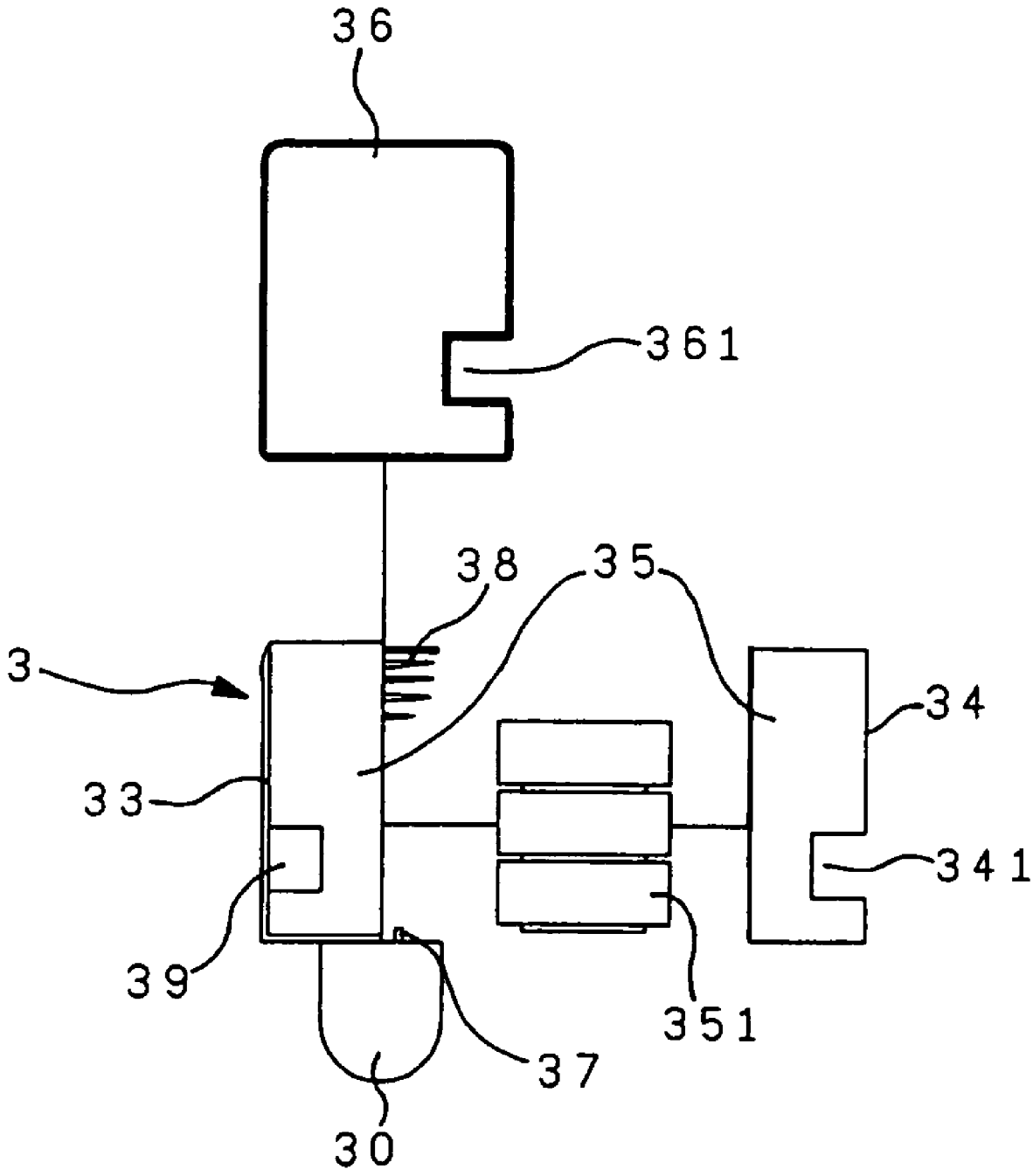
FIG. 3 is an exploded plan view of a light emitting circuit for the inflatable light stick of the present invention.

As can be seen from FIGS. 2 and 3, the light emitting circuit 3 includes a battery compartment 35 formed from a first half-case 33 and a second half-case 34 that are closed to each other, and an impact-resistant soft enclosure 36. The first half-case 33 is provided at a front end with a light-emitting diode 30, which can be varied in color, so that finished products of the inflatable light stick in use can separately show different color lights. A short pin 37 of the light-emitting diode 30 is extended into the first half-case 33. An electrically conductive spring contact 39 is located at a rear end of the first half-case 33 to contact with another pin 38 of the light-emitting diode 30. The second half-case 34 and the soft enclosure 36 each are formed at a position corresponding to contacts of batteries 351 with an opening 341, 361, respectively.

The controller 4 is in the form of an insulating pulling member 41, a front end of which is disposed between the batteries 351 of the light emitting circuit 3. A rear end of the pulling member 41 is extended through a small hole 411 to outward project from the second end of the bag body 1 to serve as a power-on control for the inflatable light stick.

Please refer to FIGS. 2 to 6. When assembling the light emitting circuit 3 to the inflatable bag body 1, the front end of the pulling member 41 is inserted into the soft enclosure 36 and the second half-case 34 via the opening 361, 341, respectively, so that the pulling member 41 is located between the batteries 351 to isolate them from one another. Then, the light emitting circuit 3 along with the pulling member 41 is enclosed in the inner bag 31 inside the chamber 32 with the rear end of the pulling member 4 outward projected from the second end of the bag body 1 to serve as the power-on controller 4.

Figure 4:
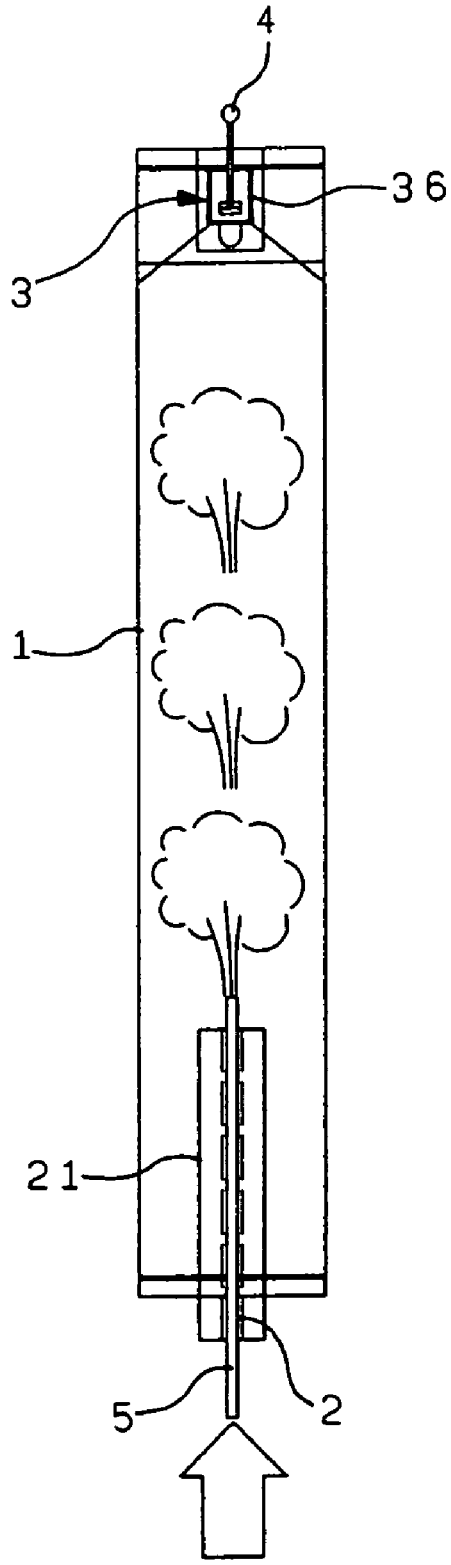
FIG. 4 shows the manner of blowing air to inflate a bag body of the inflatable light stick of the present invention.
Figure 5:
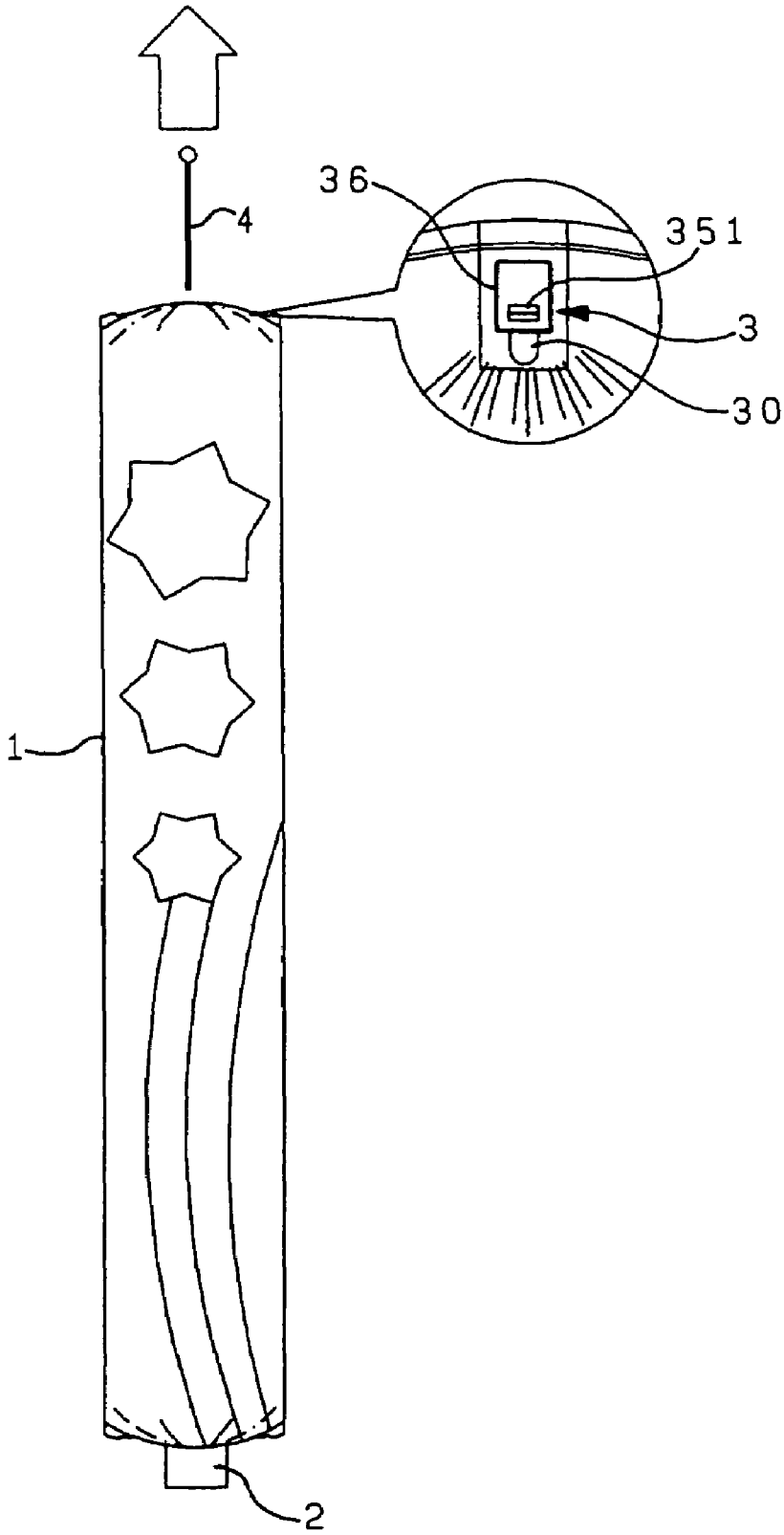
FIG. 5 shows a controller is pulled to power on the inflatable light stick of the present invention.
Figure 6:
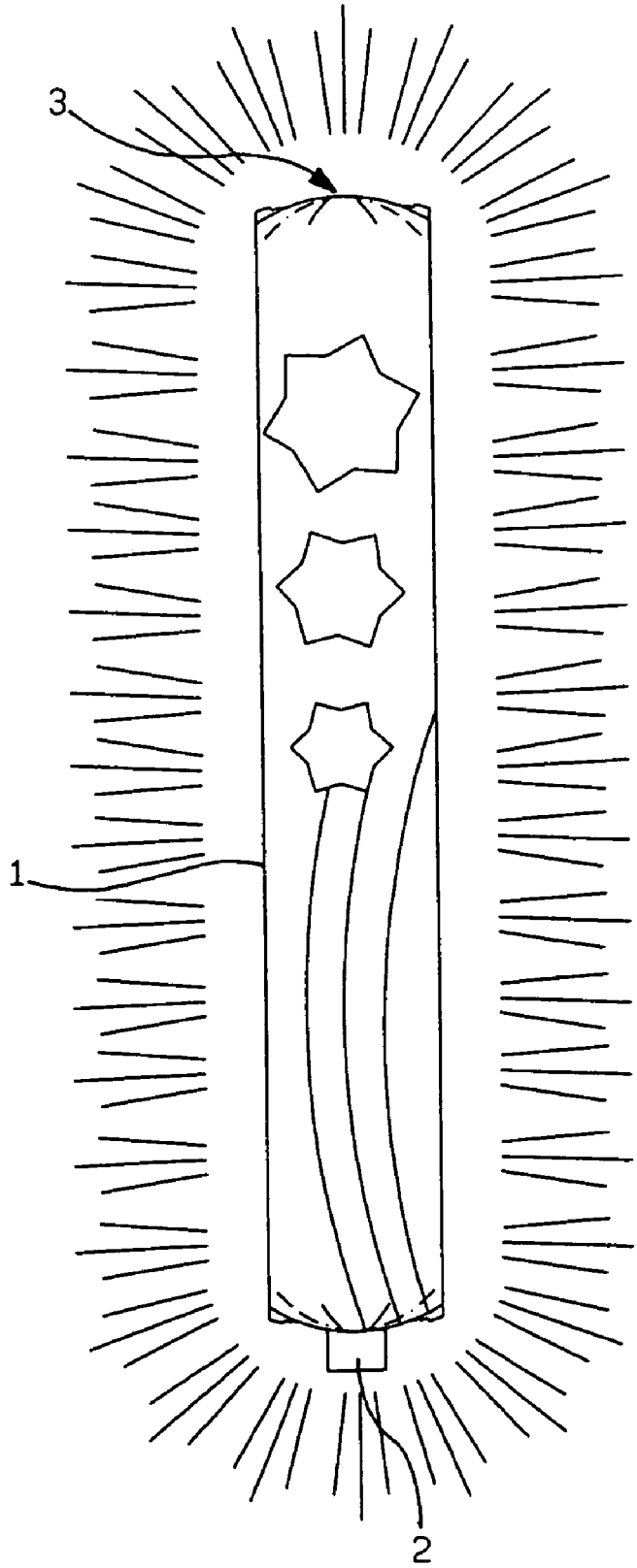
FIG. 6 is a perspective view of the inflatable light stick of the present invention in use.

Since the bag body 1 is inflatable, the bag body 1 can be deflated when the light stick is not in use. The deflated bag body 1 can be folded and stored to occupy a minimized space and be conveniently carried around. To use the light stick, a user needs only to insert a straw 5 into the inflation inlet 2 and blow air into the bag body 1 via the straw 5, as shown in FIG. 4, so that the bag body 1 is inflated and becomes a rigid and upright cheering stick. Then, the controller 4 can be timely pulled for the batteries 351 to power on the light emitting circuit 3, so that light is instantly emitted from the light-emitting diode 30, making the bag body 1 an elongate and luminous stick, which shows colorful lights and is eye-catching when being waved.

The colorful lights of the waved light sticks together with cheers from the spectators would no doubt create a joyful and exciting atmosphere in a special event.

Figure 7:
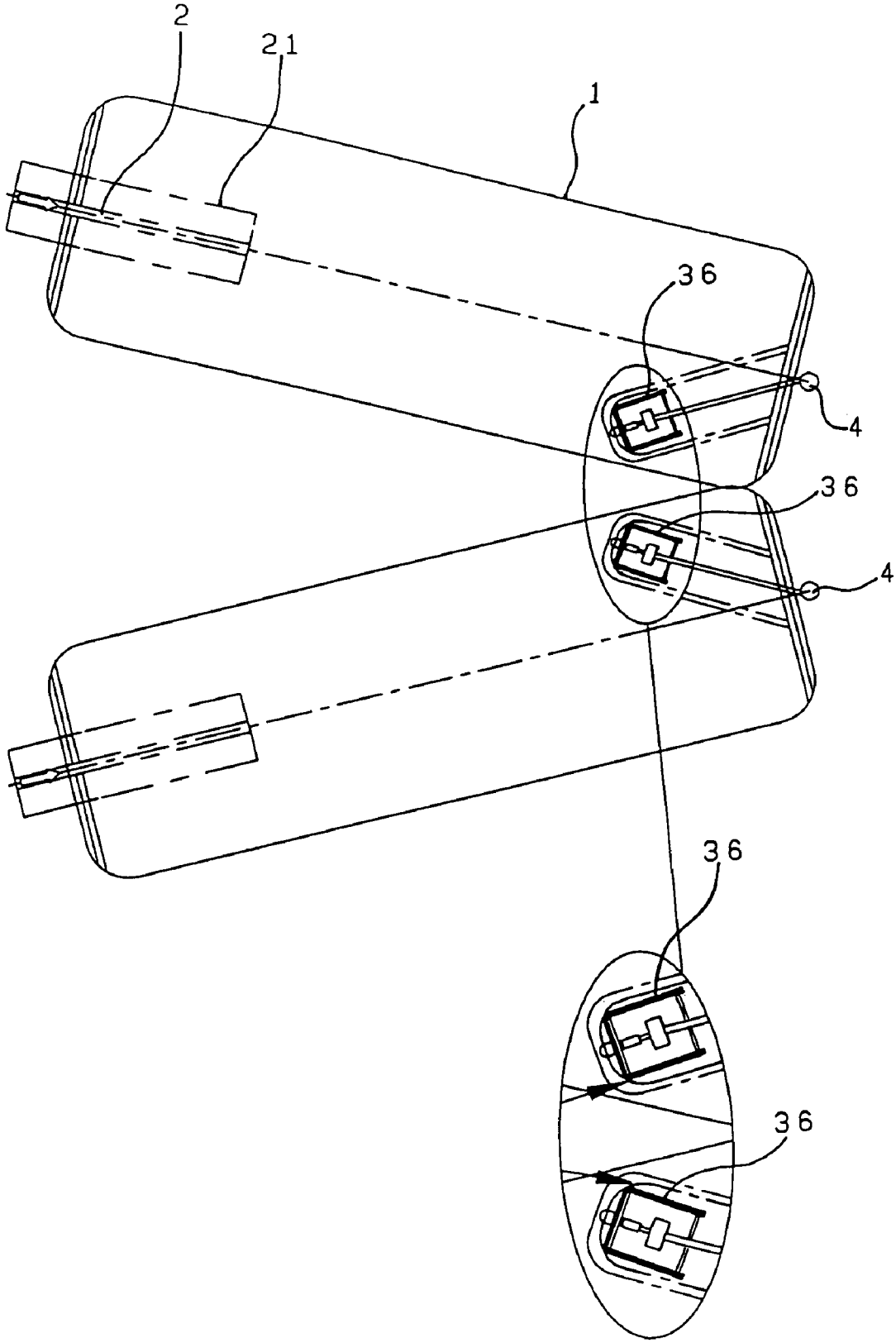
FIG. 7 shows the condition when two inflatable light sticks of the present invention collide with each other.

Please refer to FIG. 7. For the purpose of reducing an impact force when two pieces of the inflatable light sticks are collided in order to prevent the electronic light emitting circuits 3 from contacting with and thereby piercing through the bag bodies 1 to cause air leakage of the inflatable light sticks, the soft enclosure 36 is a protective cover made of an elastic material to provide an impact-resistant effect.

Moreover, for the inflatable light stick to be repeatedly usable, the controller 4 can be in the form of a switch (not shown) to control the on/off of power supply from the batteries 351. In this manner, power consumed by the inflatable light stick can be controlled.

The present invention has been described with some preferred embodiments thereof and it is understood that many changes and modifications in the described embodiments can be carried out without departing from the scope and the spirit of the invention that is intended to be limited only by the appended claims.

What is claimed is:

1. An inflatable light stick, comprising an inflatable bag body, an inflation inlet, a light emitting circuit, and a controller; the inflation inlet being located at a first end of the inflatable bag body for a user to blow air through the inflation inlet to inflate the bag body, and the light emitting circuit being located in the inflatable bag body at a second end opposite to the first end; and the controller being located at the second end of the inflatable bag body with a front end inserted into the inflatable bag body and a rear end outward projected from the inflatable bag body to serve as a power control, wherein the light emitting circuit includes a battery compartment formed from first and second half cases, an electrically conductive spring is located at a rear end of the first half-case, the light emitting circuit includes a light emitting diode having a first pin which contacts the electrically conductive spring, and an impact-resistant soft enclosure surrounds the first and second half cases.

2. The inflatable light stick as claimed in claim 1, wherein the inflatable bag body is made of an inflatable plastic material containing a fluorescent material.

3. The inflatable light stick as claimed in claim 1, wherein the inflation inlet is in the form of an elongate plastic bag partially sealed in the inflatable bag body, a front end of the inflation inlet being outward projected from the first end of the inflatable bag body and separated into two flaps; and wherein the light emitting circuit is enclosed in an inner bag provided in a chamber formed in the bag body at the second end.

4. The inflatable light stick as claimed in claim 1, wherein the first and the second half cases that are closed to each other, the first half-case being provided at a front end with the light-emitting diode, a pin of the light-emitting diode being extended into the first half-case; the second half-case and the soft enclosure each being formed at a position corresponding to electric contacts of the batteries with an opening; and the controller including an insulating pulling member to serve as the power control, a front end of the pulling member being disposed between batteries of the light emitting circuit, and a rear end of the pulling member being extended through a hole to the outwardly project from the second end of the bag body.

5. The inflatable light stick as claimed in claim 1, wherein the controller is an on/off switch.

6. An inflatable light stick, comprising an inflatable bag body being provided at a first end with an inflation inlet, via which air can be blown to inflate the bag body, and formed in a second end with a chamber, in which an inner bag is provided for enclosing a light emitting circuit therein; an insulating pulling member being disposed between batteries of the light emitting circuit to separate the batteries from each other and serve as a power-on control; an end of the pulling member being extended through a hole to outward project from the second end of the bag body; the light emitting circuit including a battery compartment formed from a first and a second half-case closed to each other, and an impact-resistant soft enclosure surrounding the first and second half-cases; a light emitting diode being located at a front end of the first half-case with a first pin extended into the first half-case, and an electrically conductive spring being located at a rear end of the first half-case to contact with a second pin of the light-emitting diode; the second half-case and the soft enclosure each being provided at a position corresponding to electric contacts of the batteries with an opening, via which the pulling member can be extended into the soft enclosure and the battery compartment to locate between and thereby separate the batteries from one another.

* * * * *